United States Patent [19]

Ramsay

[11] 4,215,980

[45] Aug. 5, 1980

[54] PERCUSSIVELY-IGNITABLE FLASHLAMP ASSEMBLY AND SELECTIVE FIRING MECHANISM THEREFOR

[75] Inventor: John P. Ramsay, Hillsboro, N.H.

[73] Assignee: GTE Sylvania Incorporated, Stamford, Conn.

[21] Appl. No.: 921,024

[22] Filed: Jun. 30, 1978

[51] Int. Cl.[2] ..... F21K 5/02

[52] U.S. Cl. ..... 431/359; 362/13

[58] Field of Search ..... 431/359; 362/11, 13, 362/14

[56] References Cited

U.S. PATENT DOCUMENTS

| | | | |
|---|---|---|---|
| 3,535,063 | 8/1968 | Anderson et al. | 431/361 |
| 4,055,759 | 10/1977 | Bouchard et al. | 431/359 |
| 4,070,145 | 1/1978 | Hall et al. | 431/359 |
| 4,076,488 | 2/1978 | Hall | 431/359 |
| 4,116,616 | 9/1978 | Hall et al. | 431/359 |
| 4,152,105 | 5/1979 | Ramsay | 431/359 |

*Primary Examiner*—Carroll B. Dority, Jr.

*Attorney, Agent, or Firm*—Lawrence R. Fraley

[57] ABSTRACT

An improved flashlamp assembly which utilizes a plurality of percussively-ignitable flashlamps disposed on an elongated support member. Firing of the flashlamps is accomplished using a spring-loaded ratchet, a movable carriage, and a striking mechanism, e.g. helical torsion spring, positioned on the movable carriage and in engagement with the ratchet. The spring engages and fires each of the lamps in response to movement of the ratchet and carriage members. The improvement comprises providing a longitudinal passage within the ratchet member to permit movement of the carriage therein. An improved firing mechanism for the assembly is also disclosed.

12 Claims, 6 Drawing Figures

PERCUSSIVELY-IGNITABLE FLASHLAMP ASSEMBLY AND SELECTIVE FIRING MECHANISM THEREFOR

CROSS REFERENCE TO RELATED APPLICATIONS

Two applications, Ser. Nos. 695,991 and 696,107, were filed June 14, 1976 and are now U.S. Pat. Nos. 4,070,145 and 4,055,759, respectively. Both of these patents, assigned to the assignee of the present invention, described percussive flashlamp signal devices wherein each lamp requires a preenergized striker, e.g. torsion spring, associated therewith.

Another application, Ser. No. 696,146 was also filed June 14, 1976 and assigned to the assignee of the present invention. This application has now matured into U.S. Pat. No. 4,076,488 and defines a flashlamp assembly which employs a spring-loaded ratchet bar and a slidable member, e.g., helical torsion spring, which fires the assembly's flashlamps during movement of the ratchet bar.

An application now listed in the Patent and Trademark Office under Ser. No. 756,928 was filed Jan. 4, 1977, now U.S. Pat. No. 4,147,497, and describes a signal device which includes a plurality of percussively-ignitable flashlamps disposed on a support, a handle, and a trigger movably oriented between the flashlamps and the handle. Another application was also filed Jan. 4, 1977 and is listed under Ser. No. 756,926, now U.S. Pat. No. D252,192. Ser. No. 756,926 is an application for a design for a flashlamp assembly. A third application was filed Jan. 4, 1977 and is now listed under Ser. No. 756,927, now U.S. Pat. No. 4,152,106. This application, like Ser. No. 756,926 and 756,928, is assigned to the assignee of the present invention, and defines advantageous features over the devices described in the aforementioned earlier applications. One of these features is the utilization of a carriage member which has the desirable striking mechanism positioned thereon. Use of this carriage, which operates in the manner defined, substantially improves alignment of the striking mechanism during its movement through the assembly's support member, said alignment essential in order to assure proper firing of the flashlamps. Accordingly, use of the described carriage member in combination with the remaining components, e.g. ratchet member, striking mechanism, etc. significantly increases the reliability of the above earlier assemblies.

BACKGROUND OF THE INVENTION

The present invention relates to flashlamp assemblies and more particularly to flashlamp assemblies which employ flashlamps of the percussively-ignitable variety. The invention further relates to selective firing mechanisms for use in the described assemblies. One particular embodiment of the invention is a signal device capable of being operated by hand.

As will be understood, the present invention represents yet another improvement in the art of flashlamp assemblies and selective firing mechanisms associated therewith. The present invention particularly represents an improvement to the assembly described in the aforementioned application under Ser. No. 756,927 by providing a more positive means of assuring alignment of the carriage and striking mechanism components within the assembly during the periods of movement therein. An added benefit from this improvement is an increased ease of assembly. Additional advantages of the present invention over the above prior devices will be understood from the following description.

It is believed, therefore, that a flashlamp assembly which assures improved alignment of the carriage and striking mechanism during periods of movement of these components within the assembly would constitute an advancement in the art.

It is also believed that a flashlamp assembly selective striking mechanism which operates in a more facile and advantageous manner than known striking mechanisms would constitute an art advancement.

OBJECTS AND SUMMARY OF THE INVENTION

It is therefore a primary object of the instant invention to enhance the flashlamp assembly art.

It is another object of the invention to provide a flashlamp assembly which operates in a more reliable manner than known assemblies of the art.

It is still another object of the invention to provide a selective firing mechanism for a flashlamp assembly using percussively-ignitable flashlamps which improves the alignment of the assembly's carriage and striking mechanisms during their movement within the assembly.

A further object of the invention is to provide a flashlamp assembly of the nature described wherein the assembly may be utilized as a hand operable signal device.

In accordance with one aspect of the present invention, there is provided a percussively-ignitable flashlamp assembly which comprises a support member defining a longitudinal channel therein, a spring-loaded ratchet member movably oriented within the support's channel, a carriage member which includes thereon a striking mechanism which is in engageable contact with the ratchet and adapted for selectively firing the flashlamps. The improvement comprises providing a longitudinal passage within the ratchet member such that the carriage member is movably oriented therein.

According to another aspect of the invention, there is provided an improved selective firing mechanism for a flashlamp assembly which includes a support member and a plurality of percussively-ignitable flashlamps positioned on the support. The mechanism comprises a spring-loaded ratchet and a movable carriage member having a resilient striking mechanism positioned thereon for selectively firing the flashlamps in response to movement of the ratchet and carriage members. The improvement comprises providing the ratchet with a longitudinal passage therein in which the carriage may move.

BRIEF DESCRIPTION OF THE DRAWINGS

FIG. 4 is taken along the line 4—4 in FIG. 3.

DETAILED DESCRIPTION OF THE PREFERRED EMBODIMENTS

For a better understanding of the present invention together with other and further objects, advantages, and capabilities thereof, reference is made to the following disclosure and appended claims in connection with the above described drawings.

With reference to the drawings, there is shown a flashlamp assembly 10 which comprises an elongated support member 13 upon which are mounted a plurality, e.g. ten, of flashlamps 15. Each lamp 15 is preferably of the percussively-ignitable variety similar to those defined in U.S. Pat. No. 3,535,063 (L. F. Anderson et al.), said patent assigned to the same assignee as the present invention. As described therein, percussive flashlamps comprise a light-transmitting envelope and a projecting primer tube. Deformation of the tube results in deflagration of thelamp's fulminating material up through the tube and the subsequent ignition of the combustible filamentary material, e.g. zirconium foil, located within the envelope. This ignition process is often described in the flashlamp industry as "firing" the lamp.

Figure 1:
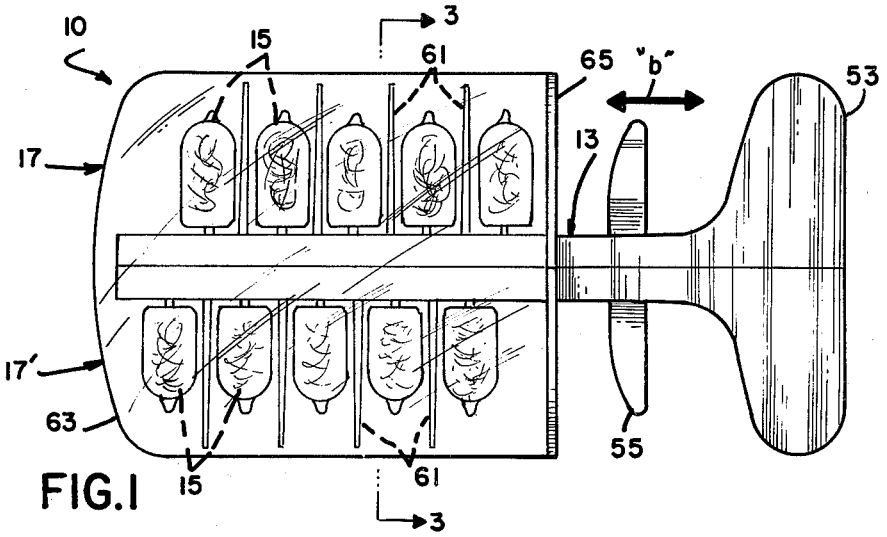
FIG. 1 is a side elevational view of a flashlamp assembly in accordance with a preferred embodiment of the invention.
Figure 3:
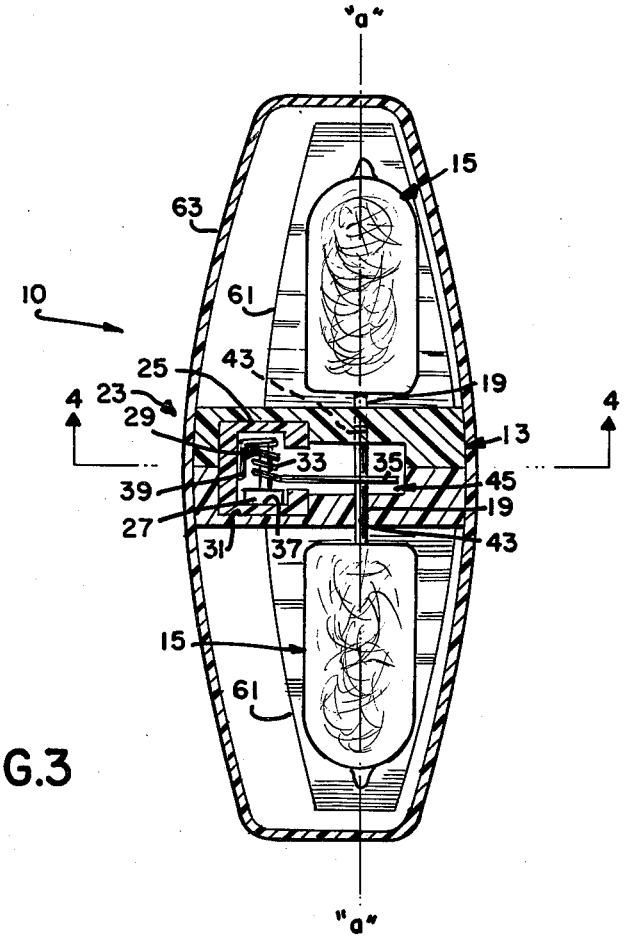
FIG. 3 is an elevational view, partly in section, of the invention as taken along the line 3—3 in FIG. 1.
Figure 2:
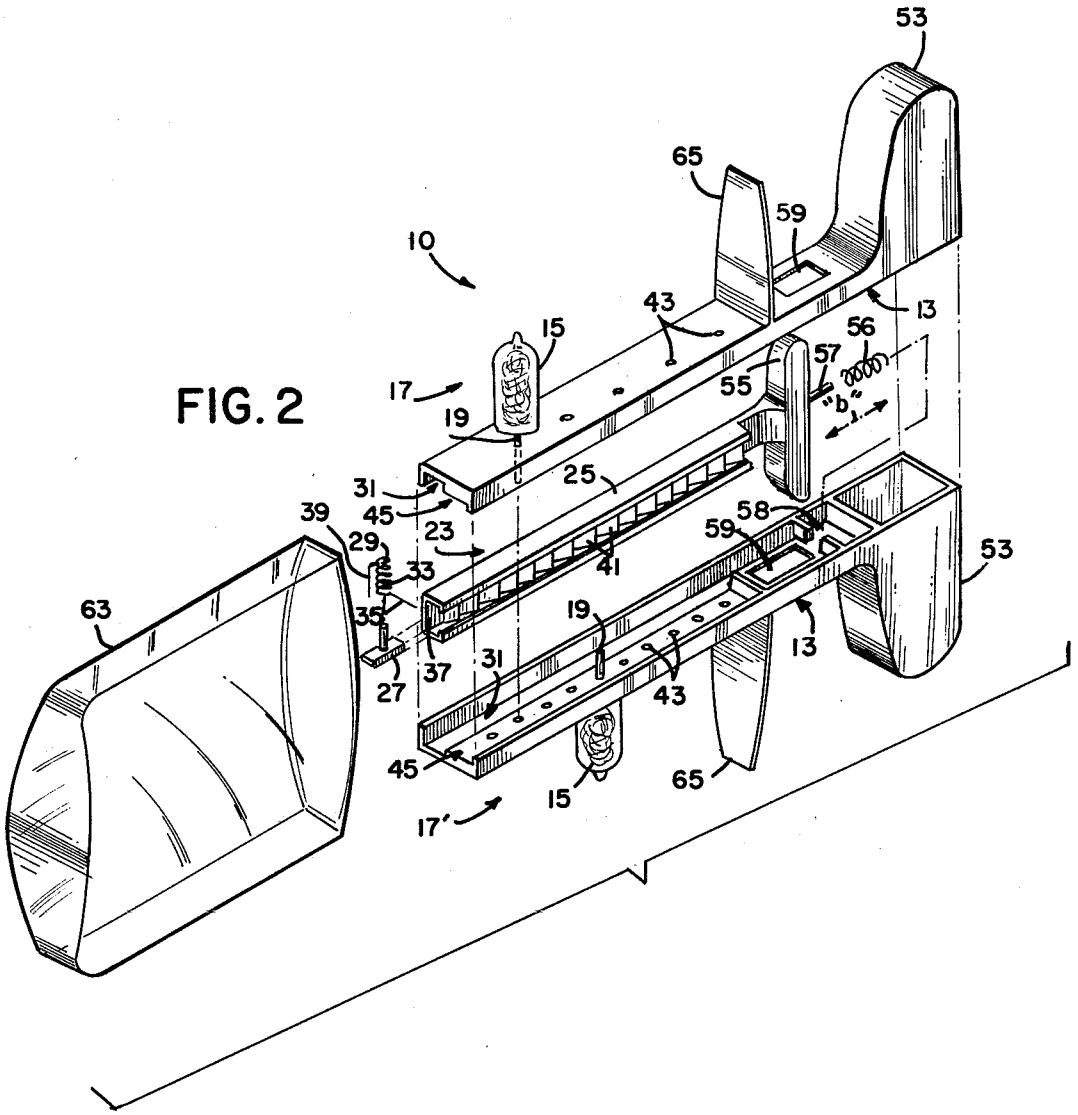
FIG. 2 is an exploded isometric view of the flashlamp assembly of FIG. 1.

The lamps 15 of the invention are preferably arranged on support 13 in two opposing and substantially parallel rows 17 and 17' (only one lamp 15 per row is shown in FIG. 2 for clarification purposes). Accordingly, the lamps in row 17' are inverted with respect to those in row 17 and the respective primer tubes 19 project from envelopes 21 in opposing directions. This positioning relationship is best illustrated in FIG. 1. It is further preferred that the primer tubes 19 of the lamps in row 17' be alternately positioned on support 13 with respect to those of the opposing lamps in row 17 and that all of the projecting primer tubes occupy a common plane "a—a" as shown in FIG. 3.

Selective firing of flashlamps 15 is accomplished by the assembly's firing mechanism 23 (FIGS. 2–6) which comprises a spring-loaded ratchet member 25, a carriage member 27, and a resilient striking mechanism 29 positioned on the carriage. Ratchet 25 is slidably positioned within a longitudinal channel 31 defined by support 13. Striking mechanism 29 is preferably a helical torsion spring 33 having an extending striker arm 35 for selectively engaging and thus deforming each of the projecting primer tubes 19 of lamps 15.

Assembly 10 represents a substantial improvement over previous such assemblies, and particularly the one defined in Ser. No. 756,927, now U.S. Pat. No. 4,152,106, by providing a longitudinal passage 37 within ratchet 25 such that carriage 27 is oriented therein during its movement to effect firing of lamps 15. Arm 35 of spring 33 thus projects from both carriage 27 and ratchet 25 to strike the respective primer tubes 19 in the desired sequence. Retention of carriage 27 within the ratchet member itself assures positive alignment of this member in addition to that of spring 33 during lamp firing. As described, such alignment is critical in order that said firing is attained in a proper manner. Slippage or misalignment of either of these components could have the adverse effect of either locking the ratchet in one position or of prohibiting the striker arm 35 from being adequately prestressed before engaging the next, adjacent primer tube. This method of operation is explained below. As shown in FIG. 3, incorporation of the carriage and spring components within the ratchet member also serves to reduce the overall width of assembly 10 in comparison to earlier assemblies, thus adding increased compactness to the list of advantageous features of the present invention.

Figure 4:
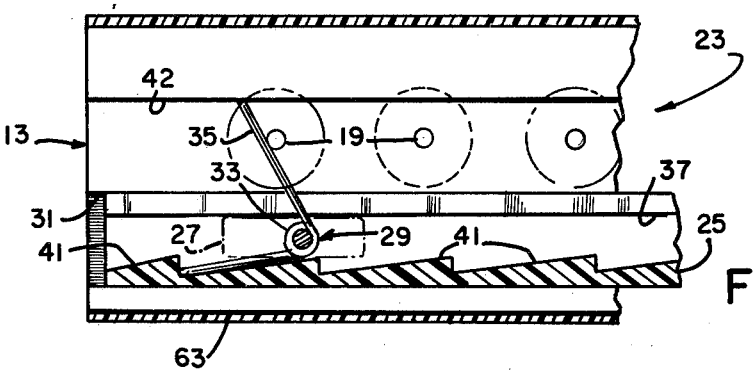
FIGS. 4–6 represent the various steps in firing one of the flashlamps of the invention.
Figure 5:
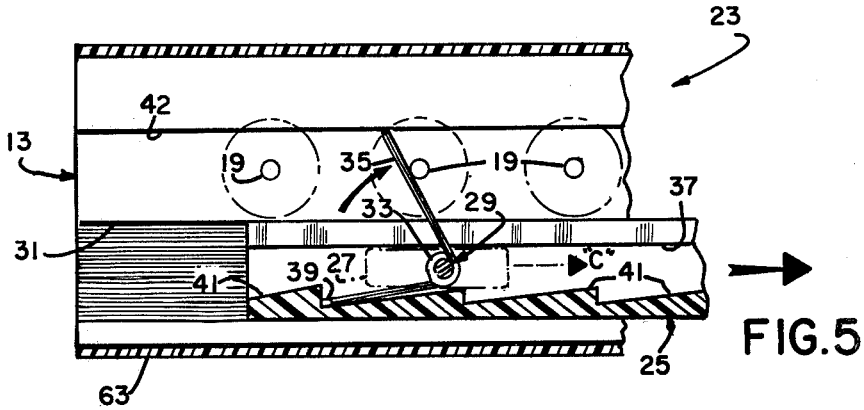
Figure 6:
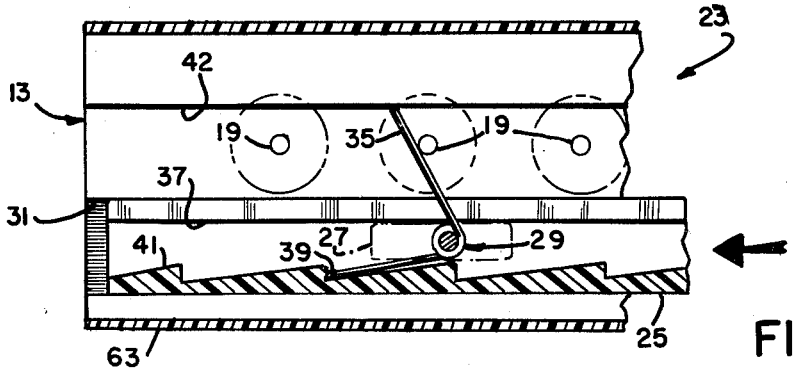

The preferred method of firing the flashlamps of the invention is shown in FIGS. 4–6. Basically, engagement and deformation of primer tubes 19 is achieved by reciprocal movement of ratchet 25 within channel 31 (shown also as direction "b" in FIGS. 1 and 2). Carriage 27, having spring 33 thereon, is moved laterally (direction "c") during this reciprocal movement to effect sequential striking of each primer tube 19. Spring 33 includes a leg portion 39 in engagement with the ratchet teeth 41 on ratchet 25 to assure this lateral movement. Return movement of carriage 27 and spring 33 is prevented during the reverse motion of ratchet 25 (FIG. 6) by the positive engagement of the end of striker arm 35 with an internal wall 42 of support member 13. During this "locking" action, leg portion 29 slides over the respective tooth on ratchet 25.

Each primer tube 19 thus serves to prestress spring 33 for the next, adjacent tube. Accordingly, striker arm 35 of spring 33 will swing up and impact the next primer (FIG. 5) with sufficient force to assure deformation thereof.

Support 13 is shown in FIGS. 2 and 3 as containing a plurality of spaced openings 43 therein for accommodating the primer tubes 19 of lamps 15. It is preferred to manufacture support 13 in two parts, as shown. Accordingly, both parts of the support contain openings 43, arranged in opposing, aligned pairs such that each pair accommodates a single primer. The lamps of one row are thus inserted within the respective part of support 13 and the primers of said lamps pass therethrough and are partially inserted within the respective openings in the opposing part. These respective, alternately oriented openings thus only occupy a partial depth within said opposing part. It can thus be seen in FIGS. 2 and 3 that support 13 defines a second longitudinal channel 45 therein in order that striker arm 35 may extend within this channel to engage the portions of primer tubes 19 located therein. In the broader aspects of the invention, it is understood that channel 45 can be omitted and only a singular opening 43 provided to accommodate one of the primers. The arrangement shown in FIG. 2 is preferred, however, to provide a two-point, spaced retention for each primer 19 with the necessary striking engagement occurring therebetween.

When utilizing the two longitudinal channels 31 and 45, it is preferred that these be oriented within support 13 in a substantially parallel relationship. It is also preferred that longitudinal passage 37 within ratchet 25 be coaxially oriented with the first longitudinal channel 31.

A preferred use for flashlamp assembly 10 is as a signal device capable of being operated by hand. As will be described, the device is adapted for single-handed operation and permits the operator to issue a signal or series of signals of relatively high intensity to indicate a condition of distress, warning, etc. When used in this manner, it is preferred that support member 13 include as a part thereof a handle portion 53 which extends from the support. Handle portion 53 is of appropriate size to be handily oriented within the palm of the assembly's user. Handle 59 can be hollow to serve as a storage compartment for an indicating dye, said material particularly desired for marine applications. A hollow handle could also include styrofoam or similar material to add buoyancy to device 10. It is also preferred to provide ratchet 25 with a trigger portion 55 which is adapted for protruding from support 13 and being engaged by the user's fingers to provide the desired movement of ratchet 25 toward handle portion 53. Return movement of the ratchet (toward lamps 15) is assured by a helical spring 56 which is positioned on an extending arm 57 of the ratchet to continuously bias the ratchet in this direction. A groove 58 is provided within support 13 to accommodate spring 56 and arm 57. A slot 59 is provided in support 13 to accommodate the extending trigger portion 55.

Incorporating trigger portion 55 as part of ratchet 25 provides yet another advantageous feature over the assembly of Ser. No. 756,927, which utilized separate components for these members. Use of a singular, integral member eliminates any opportunity for misalignment between such components. A single member also enhances assembly of the device and serves to reduce the overall number of parts.

Assembly 10 further preferably includes a plurality of light-shield partitions 61 (FIG. 1) located on support 13, each of these members positioned between a respective pair of flashlamps to eliminate sympathetic flashing of one lamp as a result of prior flashing of an adjoining lamp. Partitions 61 are not shown in FIG. 2 for clarification purposes. Assembly 10 also includes a single light-transmitting cover 63 securedly positioned on an upstanding flange 65 of support 13 and adapted for covering both opposing rows 17 and 17' of lamps 15. This also is an improvement over the prior art devices which required separate covers for each row of lamps. Understandably, a single cover reduces the number of parts required for the invention, and strengthens the overall device. A single cover also eliminates many potential sealing problems inherent in earlier devices. This latter feature is particularly critical if the invention is to be utilized in marine applications.

Support 13, ratchet member 25, carriage 27, and partitions 61 are all preferably of thermoplastic material. Cover 63 is preferably of transparent thermoplastic material while spring 33 is 0.029 inch dia. piano wire.

In addition to the above-described components, the signal device assembly may further include a sheet of reflecting material (not shown) along the interior of one of the side walls of cover 63. The reflecting surface of this sheet may be inserted so as to face the lamps and function as a reflector or visible light to enhance the signaling affect or as a mirror for daytime signaling purposes. The exterior surfaces of partitions 61 may also be made reflecting, such as by aluminizing, if desired. In addition to the reflector sheet insert (not shown) such as cellulose acetate color filter may be secured to the entire inside surface of the cover. This color filter, whether blue, yellow, orange, red or other color may serve to draw more attention to the device upon firing, and also function as a decorative feature.

Although the invention has been described with respect to specific embodiments, it will be appreciated that modifications and changes may be made by those skilled in the art without departing from the scope of the invention. For example, the dimensions and design of the helical torsion spring may be modified. In lieu of the helical torsion spring, other types of striking mechanisms with resilient striker means may be employed. The lamps may be aligned in a linear array on one side of the support member, rather than in the opposing array illustrated. Further, although specifically illustrated as a signal device, it is readily contemplated that the described flashlamp assembly with selective firing mechanism may be adapted as a photoflash unit by the addition of suitable reflectors and provision of an appropriate linkage to a camera shutter release mechanism.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a flashlamp assembly including an elongated support member defining a longitudinal channel therein, a spring-loaded ratchet member slidably positioned within said longitudinal channel, a plurality of percussively-ignitable flashlamps mounted on said support member, and a movable carriage member including a resilient striking mechanism positioned thereon in engageable contact with said ratchet member and projecting from said carriage member for selectively firing said flashlamps in response to movement of said ratchet and carriage members, respectively, the improvement wherein said ratchet member defines a longitudinal passage therein, said carriage member movably oriented within said longitudinal passage.

2. The improvement according to claim 1 wherein said longitudinal passage within said ratchet member and said longitudinal channel within said support member are coaxially oriented.

3. The improvement according to claim 1 wherein each of said flashlamps includes a light-transmitting envelope and a primer tube projecting therefrom, and said elongated support member contains a plurality of spaced openings therein each for accommodating a respective one of said primer tubes of said flashlamps, said striking mechanism selectively engaging each of said primer tubes to effect said firing of said flashlamps during said movement of said ratchet and carriage members, respectively.

4. The improvement according to claim 3 wherein said elongated support member defines a second longitudinal channel therein substantially parallel to said first channel, said primer tubes of said flashlamps extending within said second longitudinal channel, said striking mechanism selectively engaging said primer tubes within said second channel.

5. The improvement according to claim 3 wherein said flashlamp assembly is a hand-operable signal device.

6. The improvement according to claim 5 wherein said elongated support member includes a handle portion and said ratchet member includes a hand-operable trigger portion extending from said elongated support member.

7. The improvement according to claim 5 wherein said flashlamps are oriented in two substantially parallel rows on opposing sides of said support member with said primer tubes from the flashlamps in one of said rows projecting from said envelopes in a direction substantially opposite that of said primer tubes from the flashlamps in the other of said rows, said primer tubes occupying a common plane.

8. The improvement according to claim 7 further including a singular light-transmitting cover member positioned on said support member, said cover member covering both of said opposing rows of flashlamps.

9. In a selective firing mechanism for a flashlamp assembly including an elongated support member defining a longitudinal channel therein and a plurality of percussively-ignitable flashlamps mounted on said support member wherein said selective firing mechanism includes a spring-loaded ratchet member slidably positioned within said longitudinal channel, and a movable carriage member having a resilient striking mechanism positioned thereon in engageable contact with said ratchet member for selectively firing said flashlamps in response to movement of said ratchet and carriage members, respectively, the improvement wherein said ratchet member defines a longitudinal passage therein, said carriage member movably oriented within said longitudinal passage.

10. The improvement according to claim 9 wherein said longitudinal passage within said ratchet member and said longitudinal channel within said support member are coaxially oriented.

11. The improvement according to claim 9 wherein each of said flashlamps includes a light-transmitting envelope and a primer tube projecting therefrom and said elongated support member contains a plurality of spaced openings therein each for accommodating a respective one of said primer tubes of said flashlamps, said resilient striking mechanism selectively engaging each of said primer tubes to effect said firing of said flashlamps during said movement of said ratchet and carriage members.

12. The improvement according to claim 11 wherein said elongated support member defines a second longitudinal channel therein substantially parallel to said first channel, said primer tubes of said flashlamps extending within said second longitudinal channel, said striking mechanism selectively engaging said primer tubes within said second channel.

* * * * *